US006163960A

United States Patent [19]

Poitras

[11] Patent Number: 6,163,960

[45] Date of Patent: Dec. 26, 2000

[54] STATIC VENTILATOR INCLUDING A CORRUGATED PORTION

[76] Inventor: Michel Poitras, 46, du Boisé, St-Lin, Quebec, Canada, J0R 1C0

[21] Appl. No.: 09/200,445

[22] Filed: Nov. 27, 1998

[51] Int. Cl.[7] ..... F24F 7/02

[52] U.S. Cl. ..... 29/890.144; 29/890.145; 29/564; 285/44; 454/270; 454/366

[58] Field of Search ..... 454/254, 270, 454/366; 29/890.14, 890.141, 890.144, 890.145, 564; 285/42, 43, 44

[56] References Cited

U.S. PATENT DOCUMENTS 454,647 6/1891 Hallas .
1,317,574 9/1919 Grosvold .
1,648,046 11/1927 Fulton .
3,731,952 5/1973 Elwart ..... 285/44 X
5,080,007 1/1992 Maheu ..... 454/254

*Primary Examiner*—Harold Joyce

[57] ABSTRACT

A static ventilator provided with a deformable corrugated portion is described herein. The static ventilator is provided with a tubular base to be installed to the roof, a sleeve to be connected to the tubular base and a cover to be installed to the free end of the sleeve. The tubular base is provided with a deformable corrugated portion enabling the tubular base to be installed to a sloping roof while allowing the sleeve to be positioned and maintained in a generally vertical orientation. The present invention is also concerned with a method for forming a tubular base for static ventilator provided with a corrugated portion.

5 Claims, 4 Drawing Sheets

STATIC VENTILATOR INCLUDING A CORRUGATED PORTION

FIELD OF THE INVENTION

The present invention relates to static ventilators. More specifically, the present invention relates to a static ventilator incorporating a corrugated portion enabling the installation of the ventilator onto roofs of various pitches and to a method for forming such a static ventilator.

BACKGROUND OF THE INVENTION

The prior art is replete with various designs of static ventilators designed to be installed onto roofs in view of providing ventilation in attics. These static ventilators, conventionally made of galvanized steel, are usually provided with a base to be fixed to the roof under the roof covering, a vertical sleeve having an end connected to the base and a cover mounted to the free end of the vertical sleeve.

To install static ventilators onto sloping roofs, the connection between the vertical sleeve and the base has to be angled. One method used to connect the sleeve to the base is to cut an end of the sleeve at the known roof angle and then to solder the angled end to the base. A major drawback of this method is that the intense heat generated during the soldering operation weakens or destroys the rust-proofing treatment of the galvanized steel which eventually leads to water leaks.

Another method of joining the angled end of the sleeve to the base is to use plastic-cement type material to provide a leak proof joint. However, it has been found that, with time, the elasticity of such materials is greatly reduced by the constant exposure to the elements, again potentially leading to water leaks.

Canadian patent application No 2,009,776 filed on Feb. 9, 1990 by Claude E. MAHEU and entitled "TILTED SEAMLESS VENT AND METHOD FOR MAKING THE SAME" describes a method for making a seamless static vent where the vertical sleeve is integral with the base. While this is a major improvement over the conventional soldering method described hereinabove, a drawback of the method of Maheu is that a different static ventilator must be made for each roof angle.

SUMMARY OF THE INVENTION

An object of the present invention is therefore to provide an improved static ventilator free of the above-mentioned drawbacks of the prior art.

Another object of the invention is to provide a static ventilator provided with a corrugated portion allowing the sleeve to be installed onto various roof pitches while maintaining the vertical orientation of the sleeve.

More specifically, in accordance with the present invention, there is provided a static ventilator to be installed onto roofs comprising:

- a tubular base having a proximate end and a distal end; the proximate end being provided with an integral base plate configured and sized to be mounted onto a roof; the tubular base also includes a deformable corrugated portion provided between the proximate and distal ends;
- a sleeve having a first end configured and sized to be connectable to the distal end of the tubular base and a second end; and
- a cover configured and sized to be mounted to the second end of the sleeve;

wherein the corrugated portion of the tubular base allows the static ventilator to be mounted to sloping roofs while enabling the sleeve to be positioned and maintained in a generally vertical orientation.

According to another aspect of the present invention, there is provided a method for forming a base having a corrugated portion for a static ventilator comprising the steps of:

- providing a first mold having a distal end, a longitudinal axis and a cylindrical portion defining a first predetermined diameter;
- removably securing a metal sheet to the distal end of the first mold;
- spinning the first mold and the metal sheet about the longitudinal axis of the first mold;
- chasing the metal sheet against the first mold to form an intermediate base provided with a cylindrical portion of the first predetermined diameter;
- providing a second mold having a distal end, a longitudinal axis and a cylindrical portion defining a second predetermined diameter smaller than the first diameter of the first mold;
- removably securing the intermediate base to the distal end of the second mold so that the cylindrical portion of the intermediate base overlaps the cylindrical portion of the second mold;
- spinning the second mold and the intermediate base about the longitudinal axis of the first mold;
- chasing part of the intermediate base against the smaller cylindrical portion of the second mold to form the corrugated portion of the base having a corrugated portion.

Other objects and advantages of the present invention will become more apparent to one skilled in the art upon reading of the following non restrictive description of a preferred embodiment thereof, given by way of example only with reference to the appended drawings.

DESCRIPTION OF THE PREFERRED EMBODIMENT

Figure 1A:
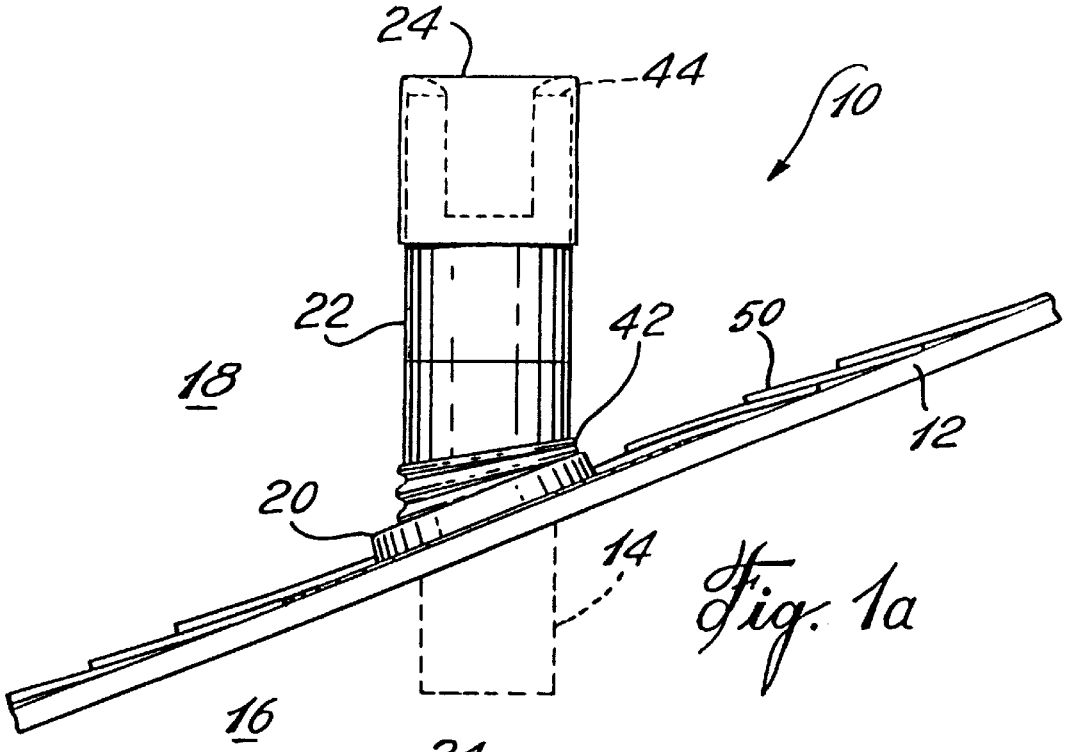
FIG. 1*a,* in a side elevational view, illustrates a static ventilator according to an embodiment of the present invention, mounted to a sloping roof.
Figure 1B:
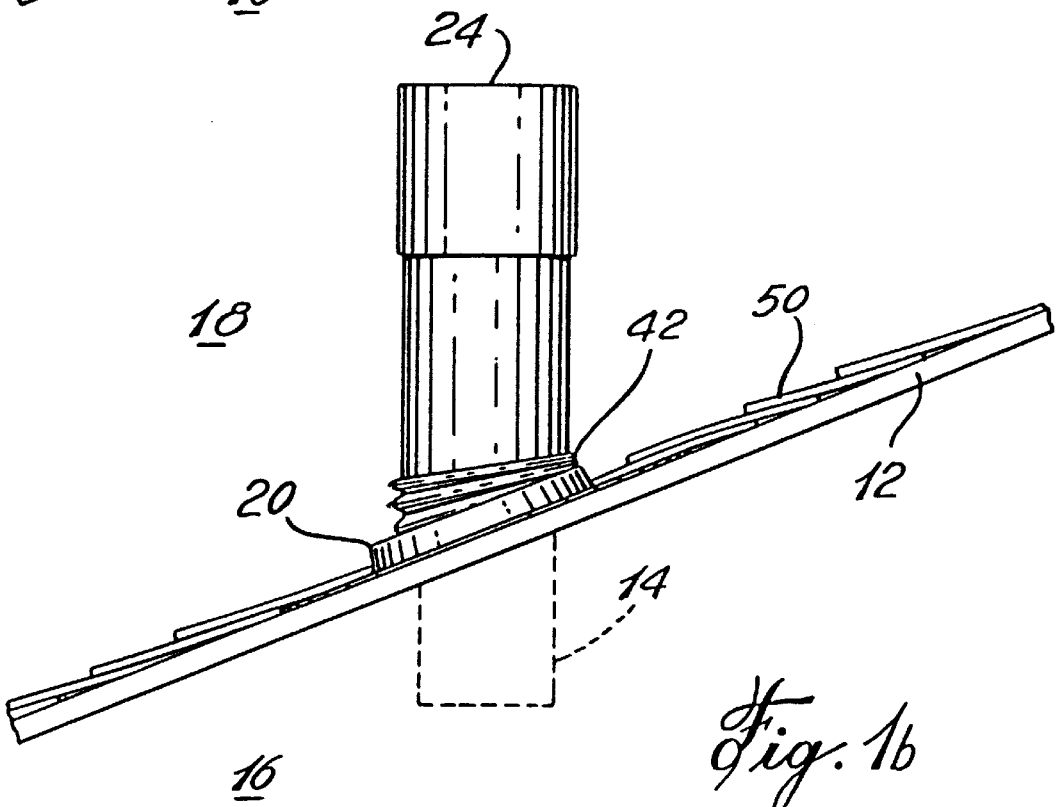
FIG. 1*b,* in a side elevational view, illustrates an alternative embodiment integrally manufactured.
Figure 2:
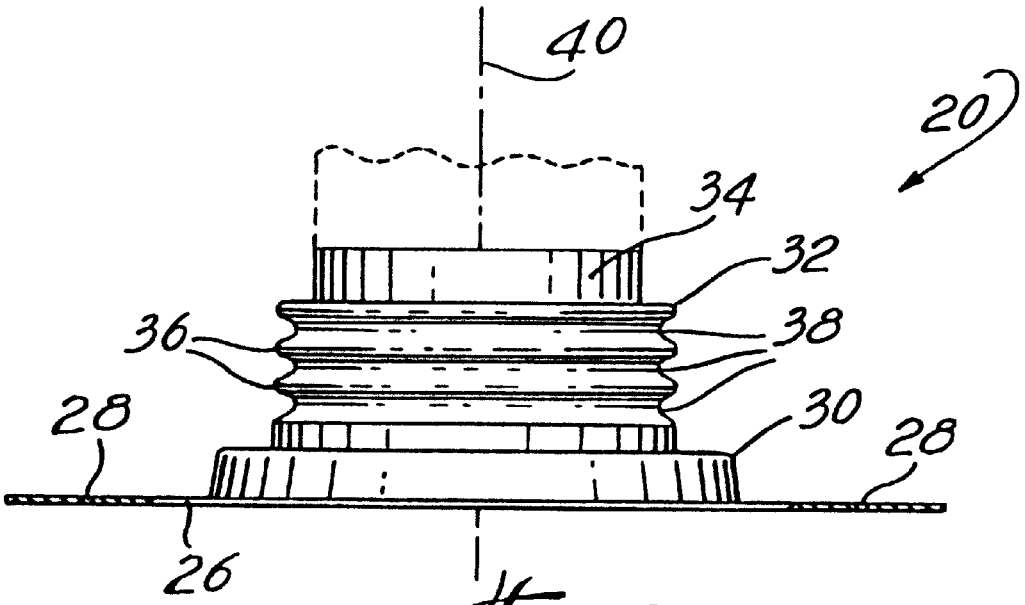
FIG. 2, in a side elevational view, illustrates the base of the static ventilator of FIG. 1.
Figure 3:
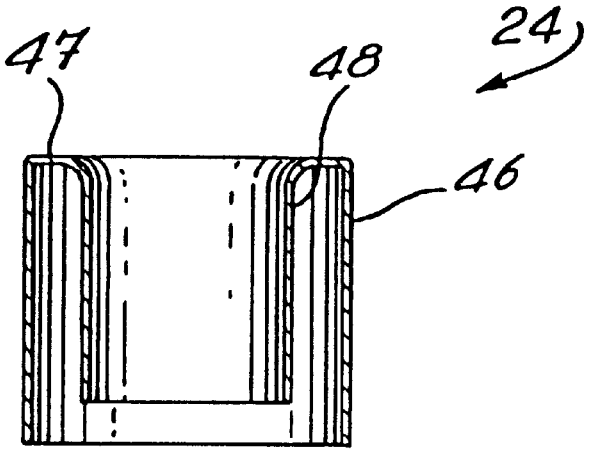
FIG. 3, in a side elevational view, illustrates the cover of the static ventilator of FIG. 1.

Turning to FIGS. 1 to 3 of the appended drawings, a static ventilator 10 according to a preferred embodiment of the present invention will be described.

FIG. 1 illustrates the ventilator 10 mounted to a sloping roof 12. The ventilator 10 encloses an air inlet pipe 14 pneumatically connecting an attic 16 to an external environment 18 so as to allow air exchange therebetween.

The static ventilator 10 includes a tubular base 20, a sleeve 22 and a cover 24.

As can be better seen from FIG. 2, the tubular base 20 includes an integral base plate 26 provided with mounting apertures 28 and defining a proximate end of the tubular base 20, a shoulder 30, a deformable corrugated portion 32 and a sleeve receiving portion 34 defining a distal end of the tubular base 20.

The integral base plate 26 is generally circular and the mounting apertures 28 are provided near the periphery of the base plate, as illustrated.

The shoulder 30 advantageously prevents contact between the corrugated portion 32 and the roof when the static ventilator 10 of the present invention is mounted to sloping roofs having a very abrupt angle (not shown).

The deformable corrugated portion 32 is formed of a plurality of successive circumferential ridges 36 and grooves 38. Of course, as will be easily understood by one skilled in the art, only one ridge 36 and one adjacent groove 38 are required to allow the corrugated portion 32 to be angled with respect to a longitudinal axis 40 that is perpendicular to the base plate 26. However, a plurality of successive circumferential ridges 36 and grooves 38 are preferred since it increases the possible angle variation, with respect to the axis 40, at which the sleeve 22 may be positioned.

As will be easily understood by one skilled in the art, the corrugated portion 32 of the tubular base 20 allows the static ventilator 10 to be mounted to sloping roofs such as 12 while enabling the sleeve 22 to be positioned and maintained in a generally vertical orientation. Indeed, by selectively deforming portions of the circumferences of the V-shaped grooves 38, it is possible to change the angle of the deformable portion 32 with respect to the base plate 26. Furthermore, since the tubular base 20 is made of metallic material, the deformation of the corrugated portion 32 will remain until other forces are applied thereto.

The sleeve receiving portion 34 is generally cylindrical and has an external diameter that is slightly smaller than an internal diameter of the sleeve 22, allowing the sleeve 22 to snugly fit onto the sleeve receiving portion 34. Of course, adhesives may be provided between the sleeve receiving portion 34 and the sleeve 22 to provide an adequate bond between these elements.

Returning to FIG. 1, the sleeve 22 is a cylindrical tube having a generally constant diameter and provided with a first end 42 to be connected to the sleeve receiving portion 34 and a second end 44 receiving the cover 24.

It is to be noted that the tubular base 20 and the sleeve 22 could be integral (not shown).

As can be better seen from FIG. 3, the cover 24 includes an external portion 46 and an integral internal portion 48.

The external portion 46 of the cover 24 is generally cylindrical and has an internal diameter larger than the external diameter of the sleeve 22 (FIG. 1) allowing the external portion 46 to be installed over the sleeve 22. The external portion 46 also includes an integral generally circular closing portion 47. The internal portion 48 is also generally cylindrical and has an external diameter smaller than the internal diameter of the air inlet pipe 14 (FIG. 1) allowing the internal portion 48 to be installed inside the air inlet pipe.

To install the static ventilator 10 to the sloping roof 12 so as to enclose the air inlet pipe 14, one simply has to adequately deform the corrugated portion 32 of the tubular base 20, insert the tubular base 20 over the air inlet pipe 14, secure the tubular base 20 to the roof 12 via fasteners such as nails (not shown) inserted in the mounting apertures 28 of the base plate 26, mount the sleeve 22 to the sleeve receiving portion 34, readjust the deformation of the corrugated portion 32 if necessary, install the cover 24 so that its internal portion 48 is inserted in the air inlet pipe 14 and its external portion 46 overlaps the second end 44 of the sleeve 22 and, finally, secure the cover 24 to the sleeve 22.

When the base plate 26 is fixedly mounted to the roof 12, conventional roof covering material, such as, for example, asphalt shingles 50 may be installed over the base plate 26 to prevent water infiltration.

Turning now to FIGS. 4–7 of the appended drawings, the general steps of the fabrication of the tubular base 20 provided with a corrugated portion 32 will be described.

The tubular base 20 is fabricated through chasing operations that are believed to be well known in the art. Hence, only the general features of these operations will be described hereinbelow since other specific features, such as, for example, the choice of lathe speed and the type of molds to be used are believed within the reach of one skilled in the art and are not specific to the present invention.

Figure 4:
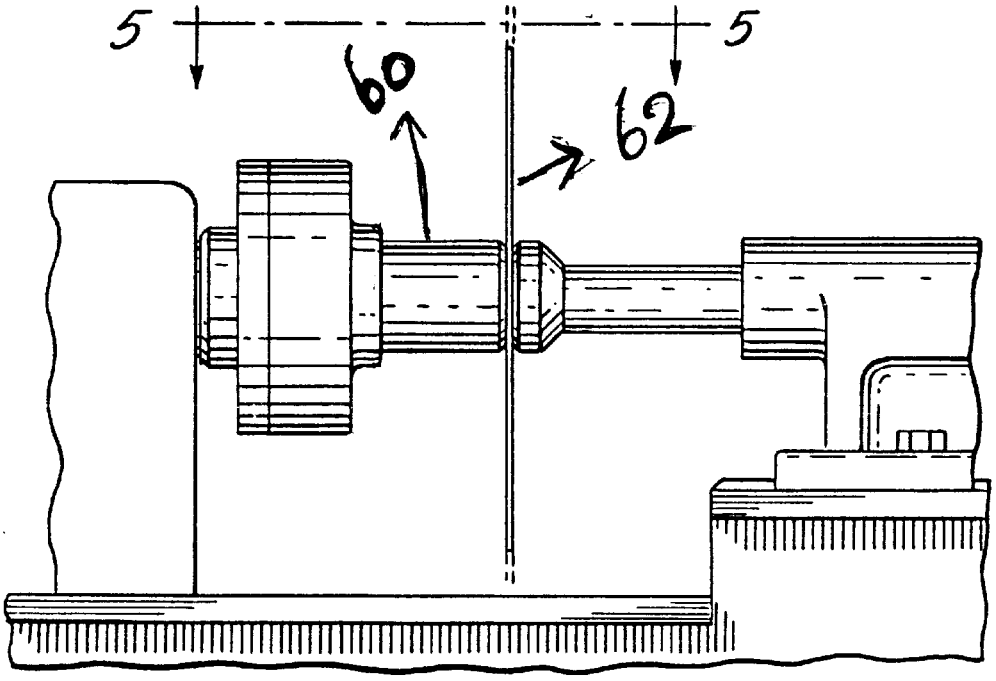
FIG. 4, in a side elevational view, illustrates a lathe supporting a blank piece of metal to be chased.
Figure 5:
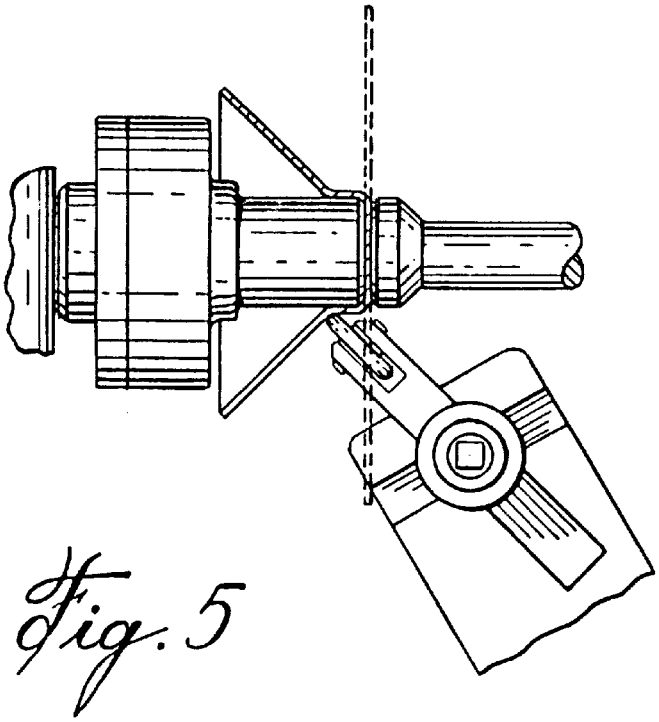
FIG. 5, in a side elevational view, illustrates the blank piece of metal of FIG. 4 being chased onto a first mold to yield an intermediate tubular base.
Figure 6:
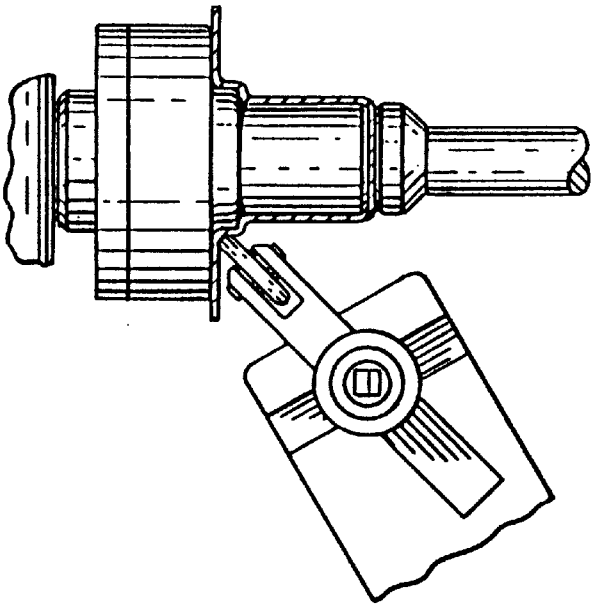
FIG. 6, in a side elevational view, illustrates an intermediate base mounted onto the first mold, before the chasing of the corrugated portion.

FIG. 4 illustrates a first mold 60, including a first cylindrical portion 62 and a distal end 64, is mounted to the spindle 66 of a lathe 68. A generally circular plate of metallic material 70 is mounted to the distal end 64 of the first mold 60 via a pressure applying member 72 of the lathe 68.

While the spindle 66 is rotated (FIG. 5) about a longitudinal axis 73, a chasing arm 74, provided with a chasing roller 76, is applied to the plate 70 to chase the plate 70 onto the first mold 60.

The result of the chasing of the plate 70 onto the first mold 60 is an intermediate tubular base 78 (FIG. 6) having a cylindrical portion 80 corresponding to the cylindrical portion 62 of the first mold 60.

When the chasing operation is completed, the lathe 68 is stopped and the intermediate tubular base 78 is disengaged from the first mold 60.

Figure 7:
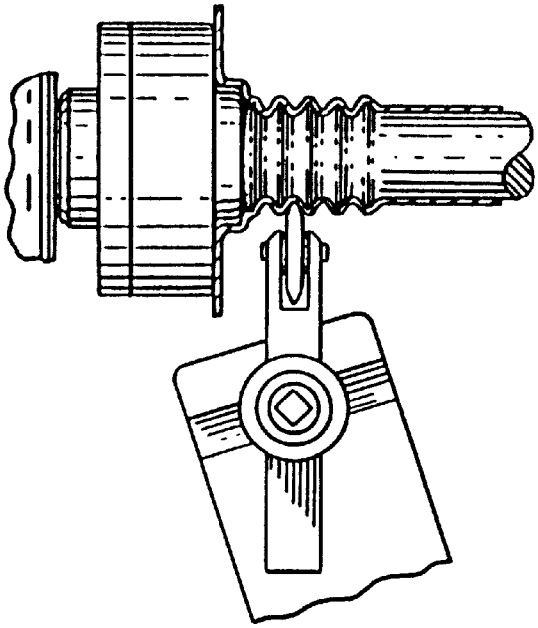
FIG. 7, in a side elevational view, illustrates the corrugated portion of the tubular base being chased.

FIG. 7 illustrates a second mold 82, including a second cylindrical portion 84 and a distal end 86, mounted to the spindle 66. The second cylindrical portion 84 has an external diameter smaller than the external diameter of the first cylindrical portion 62 of the first mold 60. The position of the second cylindrical portion 84 onto the second mold 82 is such that when the intermediate tubular base 78 is mounted to the distal end 86 of the second mold 82, the cylindrical portion 80 of the intermediate tubular base 78 is in an overlapping and distanced relationship with the second cylindrical portion 84.

The grooves 38 are chased in the cylindrical portion 80 of the intermediate base 78 to form the tubular base 20. A chasing arm 76 provided with a generally V-shaped chasing roller 88 is used to chase the generally V-shaped grooves 38. More specifically, the chasing roller 88 is pressed to the rotating cylindrical portion 80 so as to chase part of the portion 80 to the second cylindrical portion 84 of the second mold 82 to yield a V-shaped groove 38. The chasing arm is then moved and a second V-shaped groove 38 is similarly formed. The distance separating the successive grooves 38 is such that a ridge 36 is formed therebetween. When all the grooves 38 are formed, the lathe is stopped and the completed tubular base 20 is disengaged from the second mold 82.

Of course, the closed end of tubular base member 20 to which pressure was applied via the member 72 is then removed to yield an open ended tubular base member 20.

It is to be noted that while other metals could be used, the different elements of the static ventilator 10 are advantageously made of aluminum.

Although the present invention has been described hereinabove by way of a preferred embodiment thereof, this preferred embodiment can be modified at will, without departing from the spirit and nature of the subject invention as defined in the appended claims.

What is claimed is:

1. A method for forming a base having a corrugated portion for a static ventilator comprising the steps of:

providing a first mold having a distal end, a longitudinal axis and a cylindrical portion defining a first predetermined diameter;

removably securing a metal sheet to said distal end of said first mold;

spinning said first mold and said metal sheet about said longitudinal axis of said first mold;

chasing said metal sheet against said first mold to form an intermediate base provided with a cylindrical portion of said first predetermined diameter;

providing a second mold having a distal end, a longitudinal axis and a cylindrical portion defining a second predetermined diameter smaller than said first diameter of said first mold;

removably securing said intermediate base to said distal end of said second mold so that said cylindrical portion of said intermediate base overlaps said cylindrical portion of said second mold;

spinning said second mold and said intermediate base about said longitudinal axis of said first mold;

chasing part of said intermediate base against said smaller cylindrical portion of said second mold to form the corrugated portion of said base having a corrugated portion.

2. A method as defined in claim 1, wherein said spinning of said first and second molds is done on a lathe.

3. A method as defined in claim 2, wherein each said securing step is done by placing said metal sheet between said distal end of said mold and by applying pressure to said metal sheet through a pressure applying element of said lathe.

4. A method as defined in claim 1, wherein said chasing steps are done with a chasing arm provided with a chasing roller.

5. A method as defined in claim 4, wherein said second chasing step where a part of said intermediate base is chased against said smaller cylindrical portion of said second mold to form the corrugated portion is done with a generally V-shaped chasing roller.

* * * * *